US005307801A

United States Patent [19]

Schroeter et al.

[11] Patent Number: 5,307,801

[45] Date of Patent: May 3, 1994

[54] ZERO CLEARANCE FIREPLACE

[75] Inventors: Wolfgang Schroeter, Midhurst; Clifford Lilley, Anten Mills, both of Canada

[73] Assignee: Wolf Steel Ltd., Barrie, Canada

[21] Appl. No.: 921,774

[22] Filed: Jul. 30, 1992

[30] Foreign Application Priority Data

Jul. 8, 1992 [CA] Canada ..... 2073411

[51] Int. Cl.[5] ..... F23L 1/00

[52] U.S. Cl. ..... 126/515; 126/512; 126/523

[58] Field of Search ..... 126/515, 500, 516, 517, 126/518, 512, 531, 523

[56] References Cited

U.S. PATENT DOCUMENTS 2,258,882 10/1941 Craig .
2,821,975 2/1958 Thulman .
4,169,458 10/1979 Shaw .
4,224,921 9/1980 Petrescue .
4,271,815 6/1981 Johnson ..... 126/517
4,304,215 12/1981 Jarman .
4,349,009 9/1982 Patterson .
4,519,376 5/1985 Schoeff et al. ..... 126/535 X
5,016,609 5/1991 Shimek et al. ..... 126/515 X

*Primary Examiner*—Larry Jones
*Attorney, Agent, or Firm*—Kvas Miller

[57] ABSTRACT

A fireplace comprises a firebox which has a flue and front, bottom, top, rear and side panels. An outer casing is spaced from and surrounds the firebox. A combustion air plenum is positioned at a point above the bottom of the firebox and is connected to a conduit that communicates with a source external to the room in which the fireplace is situated for supplying combustion air to the fireplace. The firebox has a combustion air entry port in at least one of side panels of the firebox near the bottom of the firebox for supplying combustion air to the interior of the firebox. The combustion air port communicates with the combustion air plenum through a first passage. The flue passes upwardly through the firebox and is adapted to be connected to a second conduit that is in communication with a source external to the room which the fireplace is situated for exhausting the combustion gasses from the fireplace. A second passage is provided between the outer casing and the firebox for circulation of air to be heated along the firebox.

18 Claims, 9 Drawing Sheets

ZERO CLEARANCE FIREPLACE

FIELD OF THE INVENTION

This invention relates to fireplaces. In a preferred embodiment, the invention relates to a balanced flue, zero clearance fireplace or fireplace insert.

BACKGROUND TO THE INVENTION

Various types of fireplaces are known in the art. One traditional type of fireplace is a masonry fireplace which is built into a room of a house or other dwelling unit. Such a fireplace has a masonry firebox and a masonry chimney which extends upwardly to vent above the roof of a house. While these fireplaces may be decorative, their heating efficiency is very low. Further, these fireplaces are necessarily fixed in place and require that a room be decorated around the location of the fireplace.

One way to solve this problem has been to use free-standing fireplaces. These fireplaces may be positioned at any desired location in a room. However, unless the fireplace is heavily insulated or cooled by some means, the fireplace becomes very hot during operation and is capable of burning an unwary child.

One way to cool, or at least partially cool, the exterior surface of a fireplace is to add additional casings to the exterior of the fireplace in which insulation may be placed or through which air may be channelled. One disadvantage with this technique is that the use of the additional casings, as well as the insulation, add to the weight and bulk of a fireplace.

A further disadvantage of this technique is that the addition of casings, and passages within the casings, increases the number of steps required in the manufacture of the fireplace. This added complexity increases the overall cost of the fireplace. This is particularly the case if the fireplace is designed to burn natural gas or propane. Such fireplaces must have a sealed firebox and, accordingly, they must have sealed passages which are connected with an external source of oxygen and an external source for venting the combustion gases. Typically, such fireplaces are vented to the outdoors. The passages for the combustion air to travel from the outdoors into the firebox and the combustion gases to travel from the firebox to the outdoors must necessarily pass through at least some of the additional casings. Accordingly, the addition of casings to provide internal air flow passages can become highly labour intensive due to the need to maintain the combustion and exhaust air passages air-tight as they pass through the additional casings.

BRIEF SUMMARY OF THE INVENTION

It has now been found that these disadvantages may be overcome by using a fireplace which has a firebox having a flue and front, rear, bottom, top and two side panels, an outer casing which is spaced from and surrounds the firebox, combustion air feed means positioned on the outer casing at a point above the bottom of the firebox, and adapted for connection to first conduit means which is in communication with a source external to the room in which the fireplace is situated for supplying combustion air to the fireplace, combustion air feed port means located in at least one of the side panels near the bottom of the firebox for supplying combustion air to the interior of the firebox, first passage means positioned between the firebox and the outer casing and connecting the combustion air feed means and the combustion air entry port means, connection means positioned on the flue and adapted for connecting the flue to second conduit means in communication with a source external to the room in which the fireplace is situated for exhausting the combustion gas from the fireplace and second passage means positioned between the outer casing and the firebox for circulation of air to be heated along the firebox.

In one embodiment, combustion air entry port means is provided in each of the side panels of the firebox. Further, the combustion air entry port means may be located near the front of the firebox. The combustion air feed means is preferably positioned above the top panel of the firebox and, more preferably, is positioned above the firebox.

In another embodiment, at least a portion of the first passage is positioned adjacent the front of the fireplace, and preferably, the first passage is located substantially adjacent the front of the fireplace. As will be explained in more detail below, by positioning the first passage against at least a portion of, if not substantially all of, the front side panels of the fireplace, the front side panels of the fireplace may be at least partially cooled by the incoming combustion air. This assists in reducing the possibility of a person, such as an unwary child, being burned if they accidentally touch the front side panels of the fireplace when the fireplace is in use.

The particular design may be used either with a free-standing fireplace or with a fireplace insert which is designed to be installed in a pre-existing masonry fireplace. For the purpose of this disclosure, "fireplace" is used to refer to both a free-standing fireplace as well as a fireplace insert.

Fireplaces according to the instant design have a better distribution of air into the firebox. This improves the performance of the burner and accordingly the combustion of the fuel. Further, the combustion air is heated as it travels down the sides of the firebox. The heating of the combustion air increases the efficiency of the combustion and produces a more efficient fireplace. In addition, the heating of the combustion air permits the flame of the fireplace to burn with less primary air and more secondary air thus producing a flame which is yellower and which accordingly better simulates a "wood flame".

The positioning of the combustion air plenum and the combustion air passageways on the top and down the sides of the firebox results in the top and the sides of the fireplace being cooler and results in a fireplace having a safer design for a homeowner. Further, in one embodiment, the fireplace may have a sealed combustion chamber having a door and the combustion air may be introduced at the front of the firebox. This design helps to keep the front panel of the fireplace cooler and cleaner, thus also increasing the safety of the fireplace.

The fireplace may incorporate a zero clearance design on the back of the fireplace. This results in minimizing the amount of area in the room which is dedicated to the fireplace. At the same time, the design allows for both the width and the height of the fireplace to be maximized so as to increase the area on the inside of the fireplace which is visible.

Fireplaces according to the instant design require fewer or less complicated components thus facilitating the manufacture of the units. The fireplaces have fewer plenums than other fireplaces known in the art and are accordingly relatively light-weight. Further, the design requires fewer manufacturing steps and thus facilitates the assembly of the fireplace.

In addition, in one embodiment, an optional baffle is included in the fireplace. The baffle causes more heat to radiate out to the front of the fireplace thus resulting in a lower flue temperature and higher combustion efficiencies.

The substance and advantages of the present invention will be more fully and completely described in accordance with the following description, and the accompanying drawings, of a preferred embodiment of the invention.

DETAILED DESCRIPTION OF THE PREFERRED EMBODIMENT

Figure 1:
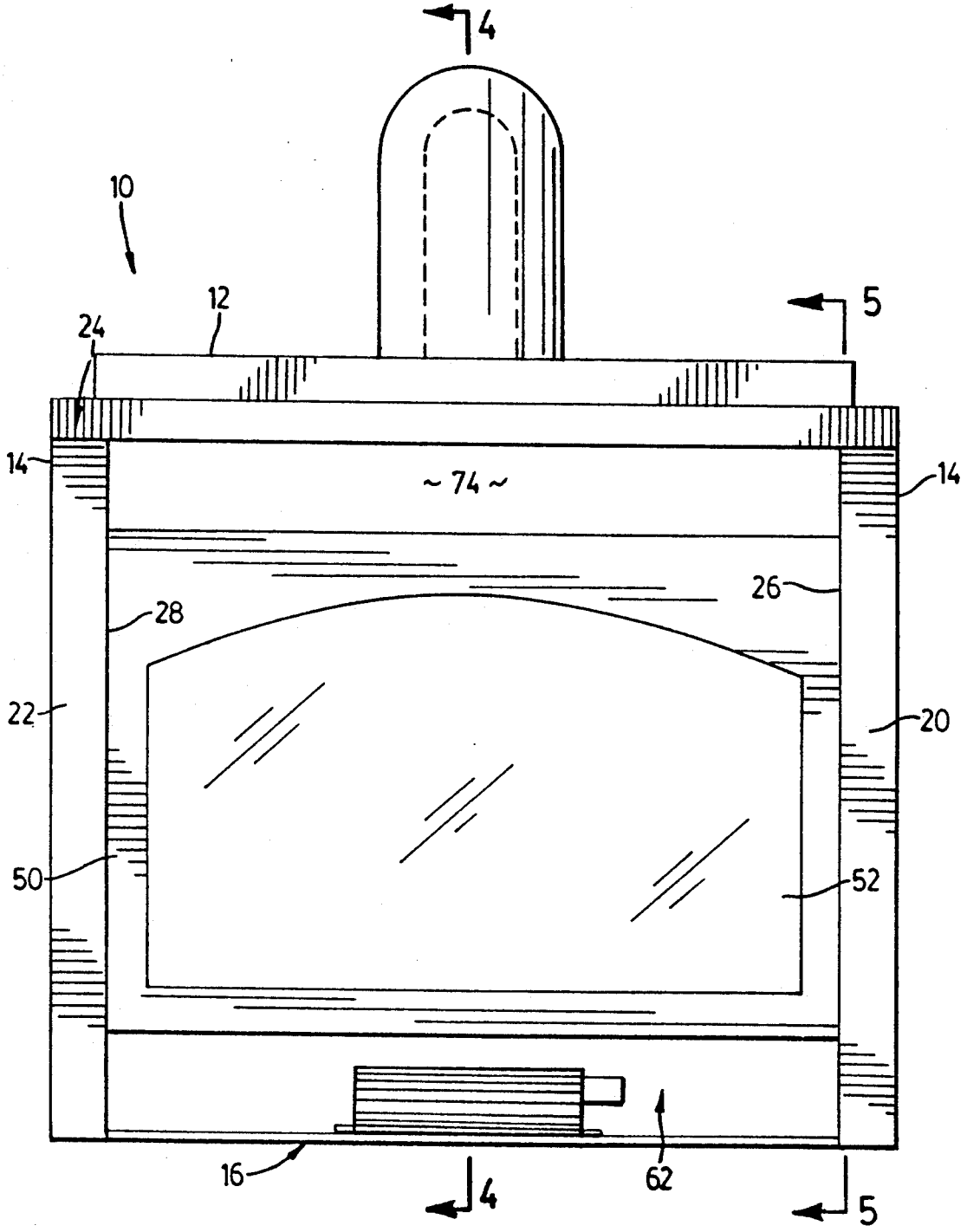
FIG. 1 is a front view of a fireplace according to the invention.
Figure 2:
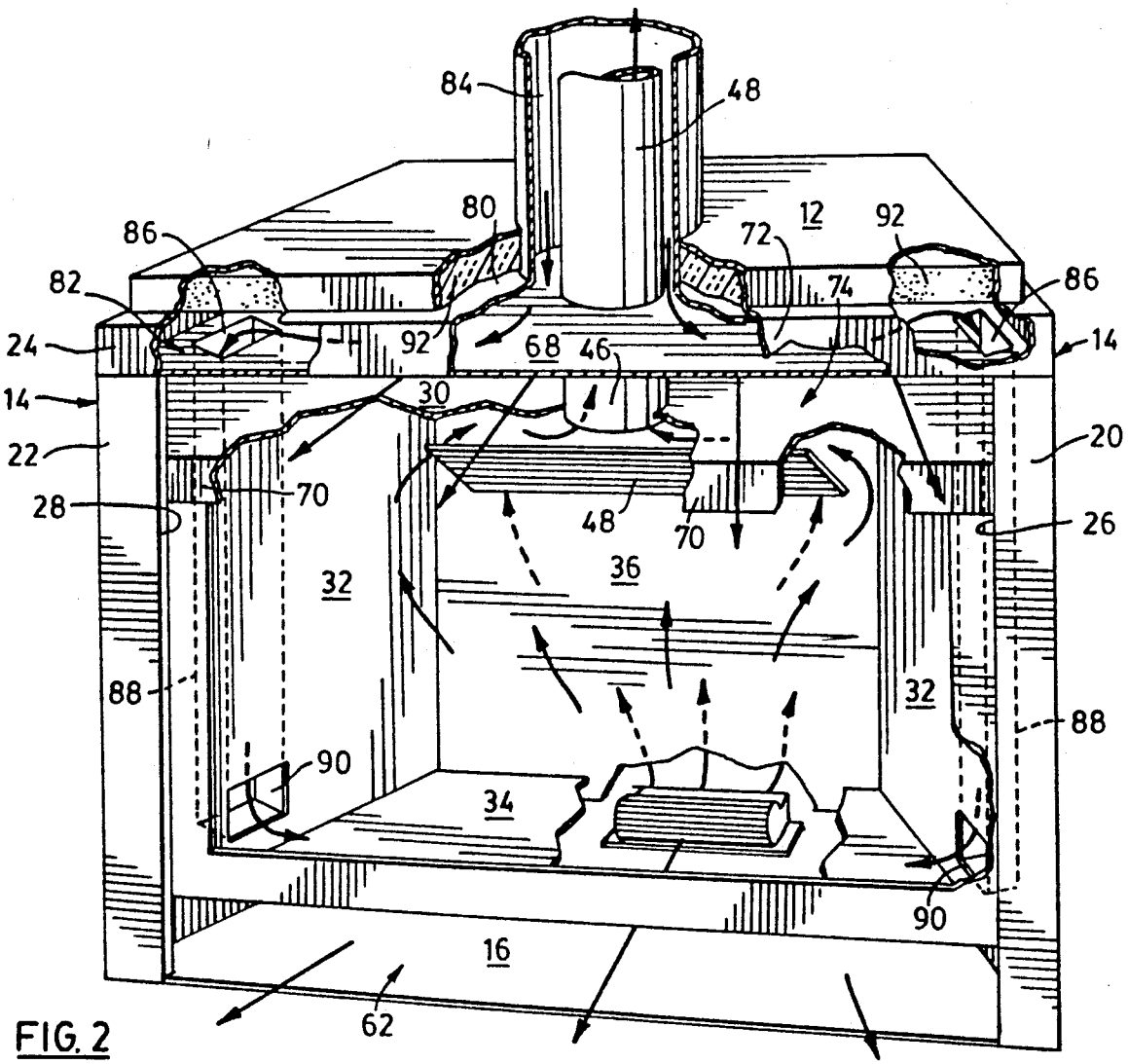
FIG. 2 is a partially cut away front perspective view of the fireplace of FIG. 1.
Figure 4:
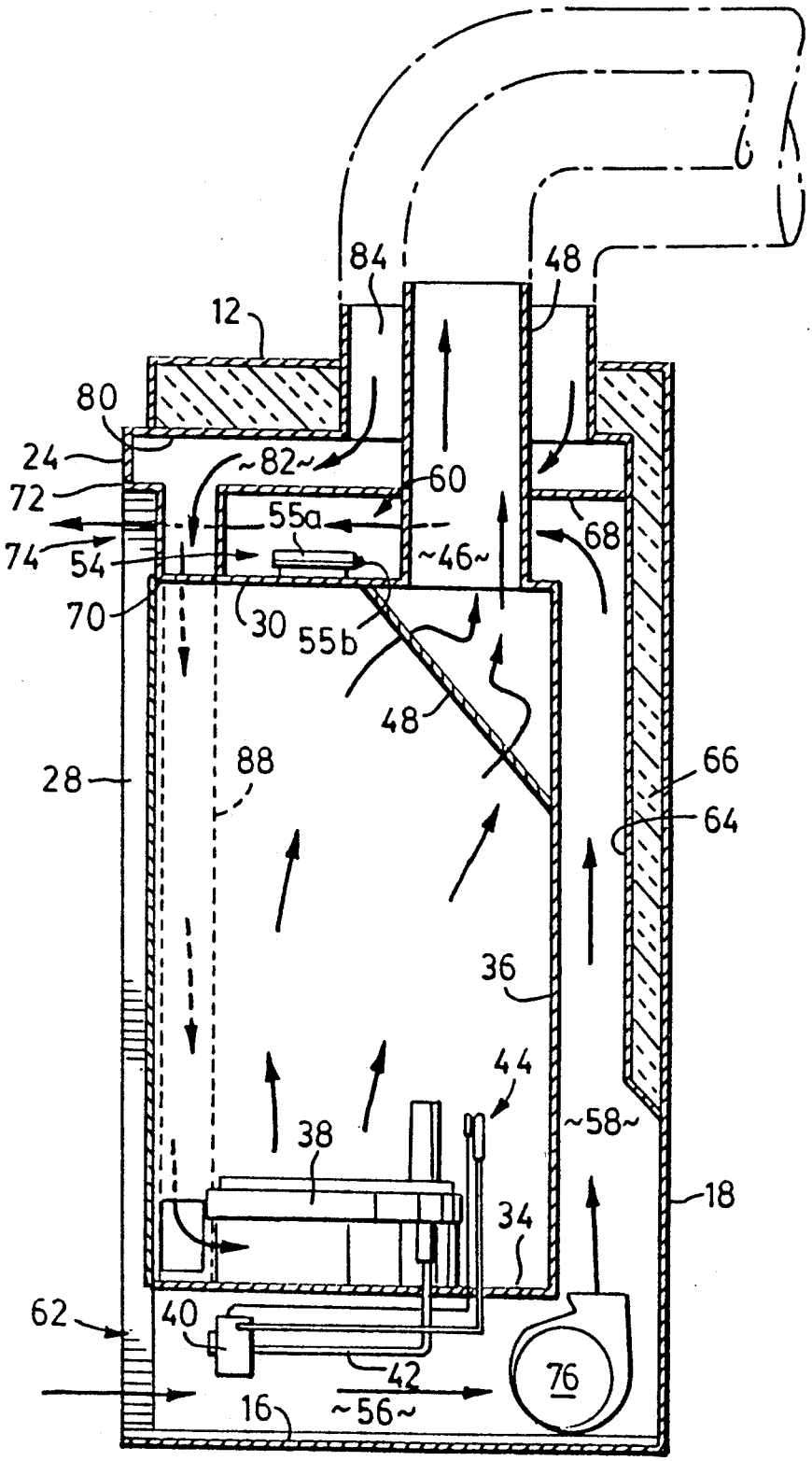
FIG. 4 is a cross-section along the line 4—4 in FIG. 1.

As shown in FIGS. 1, 2 and 4, fireplace 10 has a top casing panel 12, two side casing panels 14, a bottom casing panel 16, and a rear casing panel 18. Top casing 12, side casing panels 14, bottom casing 16 and rear casing 18 define the top. sides, bottom and rear respectively of fireplace 10.

Fireplace 10 also has right front casing panel 20, left front casing panel 22 and upper front casing panel 24. These panels are positioned at the side and top periphery of the front of the fireplace. The inside edge of right front casing panel 20 is designated by reference numeral 26 and the inside edge of left front casing panel 22 is designated by reference numeral 28.

Positioned inside the outer casing of the fireplace is a firebox. The firebox is defined by top panel 30, right and left side panels 32, bottom panel 34 and rear panel 36. While the firebox is shown as being rectangular in the attached drawings, the firebox may be of any desired shape. The outer casing is positioned so as to be spaced from and so as to surround the firebox.

If the fireplace is designed for burning a solid organic fuel such as wood, then a grate or other holding means may be provided on bottom panel 34. Alternately, if the fireplace is to be used to burn a gaseous fuel, such as natural gas or propane, then a burner unit may be provided. As shown in FIG. 4, a burner 38 may be provided in the lower portion of the firebox. As is known in the art, the gaseous fuel may be supplied to the firebox through a pipe (not shown) positioned underneath the firebox. The pipe connects with a regulator 40. The gaseous fuel passes from regulator 42 to burner 38 via pipe 42. The burner unit may also be supplied with an igniter and detector as generally indicated by reference numeral 44 in FIG. 4.

Flue 46 is provided for exhausting the combustion gases from the firebox. Accordingly, flue 46 is provided at an upper portion of the firebox. In the preferred embodiment shown in the attached drawings, the flue is provided in top panel 30 of the firebox and, in particular, flue 46 is centrally located in top panel 30 adjacent rear panel 36. Thus, the combustion gases will rise up through the firebox and enter flue 46.

As will be explained in more detail below, in order to increase the distance which the combustion gases travel inside the firebox, and to accordingly increase the transfer of heat from the combustion gases to air circulated around the firebox, baffle 48 may be provided above burner 38. As shown in the attached drawings, baffle 48 is a rectangular sheet of heat resistant material, such as sheet metal, which extends from rear panel 36 to top panel 30 of the firebox. Baffle 48 extends substantially across the entire width of the firebox. Accordingly, as show in FIGS. 2 and 3, as the combustion air rises from burner 38, the combustion gases are deflected by baffle 48 towards side panels 32. The increased flow of air along side panels 32 increases the transfer of heat to air circulating along the outside surface of side panels 32.

As discussed above, the fireplace may be equipped to burn either a solid organic fuel, such as wood, or a gaseous fuel such as natural gas or propane. If a gaseous fuel is to be combusted in the fireplace, then government regulations typically require that the firebox be sealed. To this end, the firebox may be provided with door 50 (see FIG. 1). Door 50 may be affixed by any means known in the art to either the firebox itself or to the outer casing. Further, as shown in FIG. 1, door 50 may also have a transparent panel, such as a glass window 52 positioned centrally therein. Optionally, such transparent panels may be provided in more than one side of the firebox.

If the fireplace is to burn a gaseous fuel, then typically, government regulations also require that the firebox be provided with blow out means. The blow out means may comprise a plurality of blow out ports which are provided on one of the upper walls of the firebox. In the instant design, it has been found advantageous to position a plurality of blow out ports 54 in top panel 30 of the firebox (see FIGS. 4, 5 and 6). The blow out ports may simply comprise metal lids **55*a* hinged at 55*b* and normally closed by gravity. They are hinged at 55*b*** so that if an overpressure in the firebox occurs, they will rise to vent the overpressure and will then close again.

Figure 5:
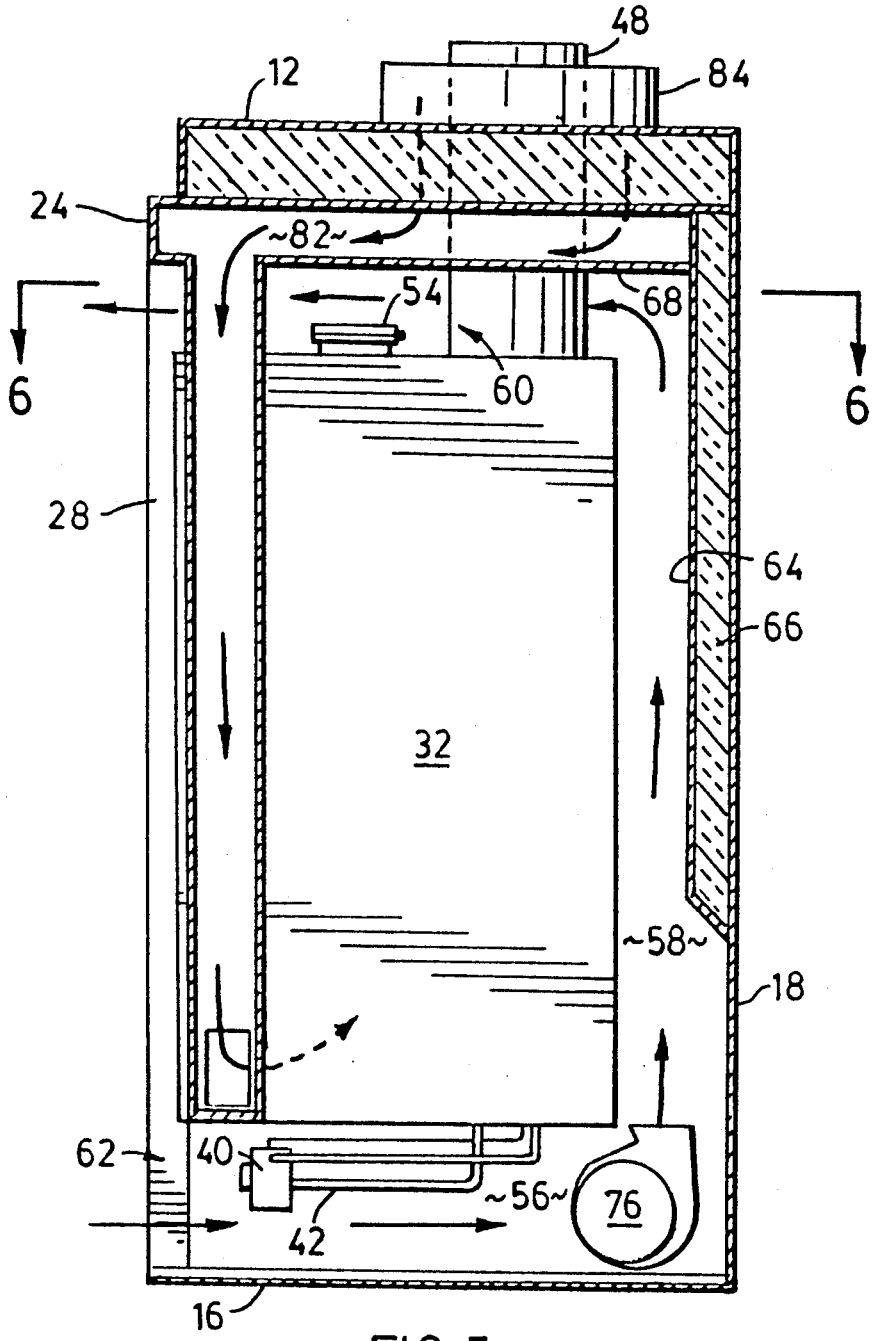
FIG. 5 is a cross-section along the line 5—5 of FIG. 1.
Figure 6:
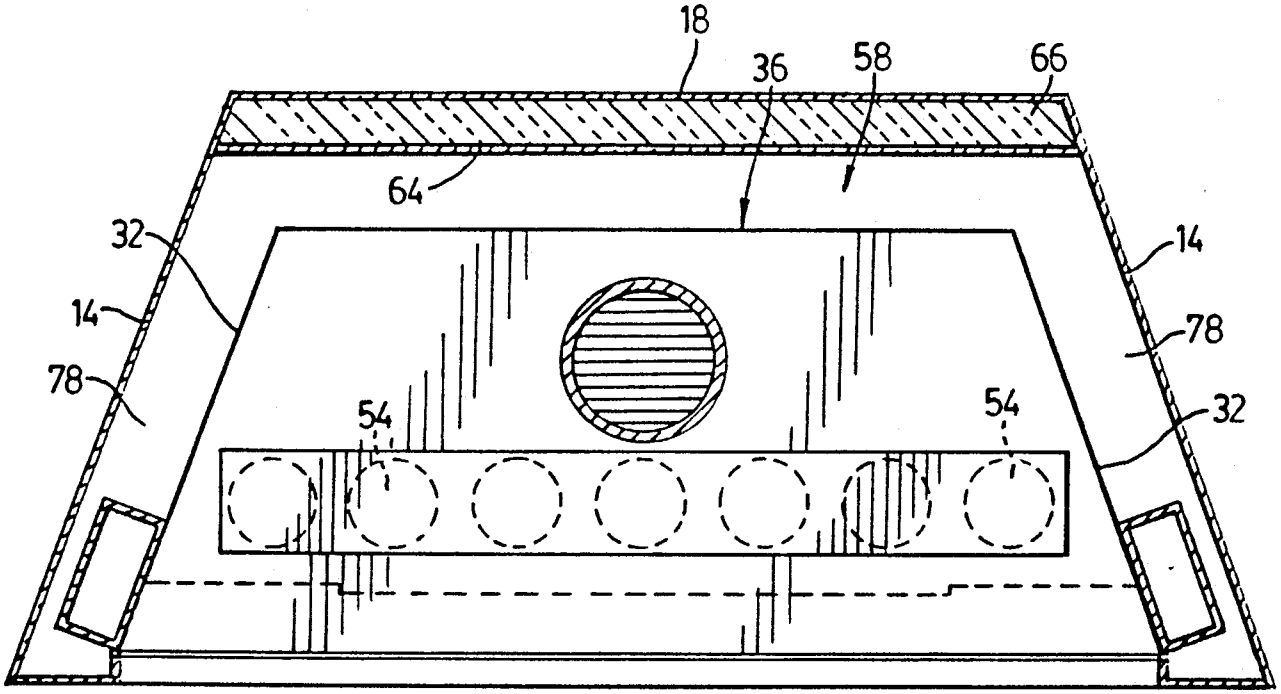
FIG. 6 is a cross-section along the line 6—6 in FIG. 5.

By positioning the outer casing so as to be spaced from and so as to surround the fireplace, a passage is provided for the circulation of air along the outside of the panels of the firebox. Generally, any source of air may be used for circulation through this air passage. Preferably, the air passage is in communication with the room in which the fireplace is situated and the room air is circulated around the fireplace. As shown in FIGS. 4, 5 and 6, the air passage may comprise lower room air plenum 56, rear room air plenum 58 and upper room air plenum 60.

Lower room air plenum 56 is positioned between bottom panel 34 of the firebox and bottom casing panel 16. Lower room air plenum 56 may extend substantially the entire width of the space below the firebox. Room air entry port 62 is located at the front portion of lower room air plenum 56 and is defined by inside edge 26 of right front casing panel 20, inside edge 28 of left front casing panel 22, the front portion of bottom casing panel 16 and the front portion of bottom panel 34 of the firebox.

If the fireplace is to be a zero clearance fireplace, and if the temperature of rear casing panel 18 is greater than desired, then insulation may be provided along the rear wall of the fireplace. In such cases, the insulation may not be required to extend all the way to the bottom portion of the fireplace but may terminate at a position in the lower half of the fireplace. In particular, as shown in FIGS. 4, 5 and 6, rear room air panel 64 may be provided at a position outwardly from rear panel 36 of the firebox. A dead air space or, more preferably, insulation may be provided between rear room air panel 64 and rear casing panel 18 as generally designated by reference numeral 66. Rear room air plenum 58 is located between rear panel 36 of the firebox and the outer wall defined by rear casing panel 18 and rear room air panel 64. As shown in FIG. 6, rear room air plenum may extend across the entire rear surface of the firebox.

Top room air panel 68 is positioned upwardly from top panel 30 of the firebox. Upper room air plenum is positioned between top room air panel 68 and top panel 30 of the firebox. Once again, upper room air plenum 60 may extend substantially the entire width across the top of the firebox. As shown in FIG. 4, top panel 30 of the firebox has a front edge 70 and top room air panel 68 has a front edge 72. Room air exit port 74 is provided at the front portion of upper room air plenum 60 and is defined by inside edge 26 of right front casing panel 20, inside edge 28 of right front casing 22, front edge 70 of top panel 30 of the firebox and front edge 72 of top room air panel 68.

Accordingly, room air enters lower room air plenum 56 via room air entry port 62, travels along the bottom of the firebox and then up the rear of the firebox through rear room air plenum 58 and then across the top of the firebox through upper room air plenum 62 to exit the fireplace via room air exit port 74. As it travels along this path, the room air is heated by contact with the walls of the firebox, as is conventional. A blower may be provided to increase the flow of air through the room air plenums. Blower 76 may be positioned at any desired location in the room air plenums. As will be appreciated, once fireplace 10 is in operation, room air would be drawn via natural convection into room air entry port 62, through the room air plenums and out room air exit port 74. However, blower 76 could be oriented to reverse the natural direction of travel of the room air such that the room air would enter via the top of the unit, then travel downwardly along rear room air plenum 58 and out port 62. In the preferred embodiment, blower 76 is provided towards the rear of lower room air plenum 56 so as to enhance the natural convection of the room air.

In order to further increase the transfer of heat from the combustion gasses to the room air, side room air plenums 78 may be provided (see FIG. 6). In this embodiment, the room air which enters via port 62 may travel upwardly along the rear panel 36 of the firebox and also along side panels 32 of the firebox. Upper room air plenum 60 extends across the top of the firebox and is in communication with rear room air plenum 58 and side room air plenums 78. Accordingly, the room air, which passes up the rear air plenum as well as the side plenums, travels through upper room air plenum 62 and exits the fireplace via room air exit port 74. It will be appreciated by those skilled in the art that one or more of the rear or side plenums may be blocked by placing insulation therein. For example, insulation may be placed in side plenums 78 thus causing all of the room air to circulate up rear room air plenum 58. Alternately, insulation may be placed in rear room air plenum 58 forcing all of the room air to travel up side room air plenums 78.

Combustion air feed means is positioned on the outer casing at a point above the bottom of the firebox. As discussed earlier, the firebox may be of any particular shape which is desired and, accordingly, the outer casing of the fireplace may be of similar shape. The combustion air feed means may also be suitably positioned so as to conform with the desired outer shape of the fireplace. Preferably, the combustion air feed means is located above the firebox.

As shown in FIGS. 2 and 4, upper combustion air panel 80 is provided at a position above top room air panel 68. The combustion air feed means comprises combustion air plenum 82 which is located between upper combustion air panel 80 and top room air panel 68. Combustion air plenum 82 may extend substantially across the entire width of the fireplace and may extend from the front of the fireplace rearwardly to rear room air panel 64 or may alternately terminate at a position frontwardly of this panel. Insulation, designated by reference numeral 92, is provided in the space between top casing panel 12 and panel 80.

Outer conduit 84 is provided on upper combustion air panel 80 and extends upwardly through top casing panel 12. While outer conduit 84 may be positioned at any particular location on upper combustion air panel 80, preferably, outer conduit 84 is located centrally of the width of upper combustion air panel 80 towards the rear of the fireplace.

Figure 3:
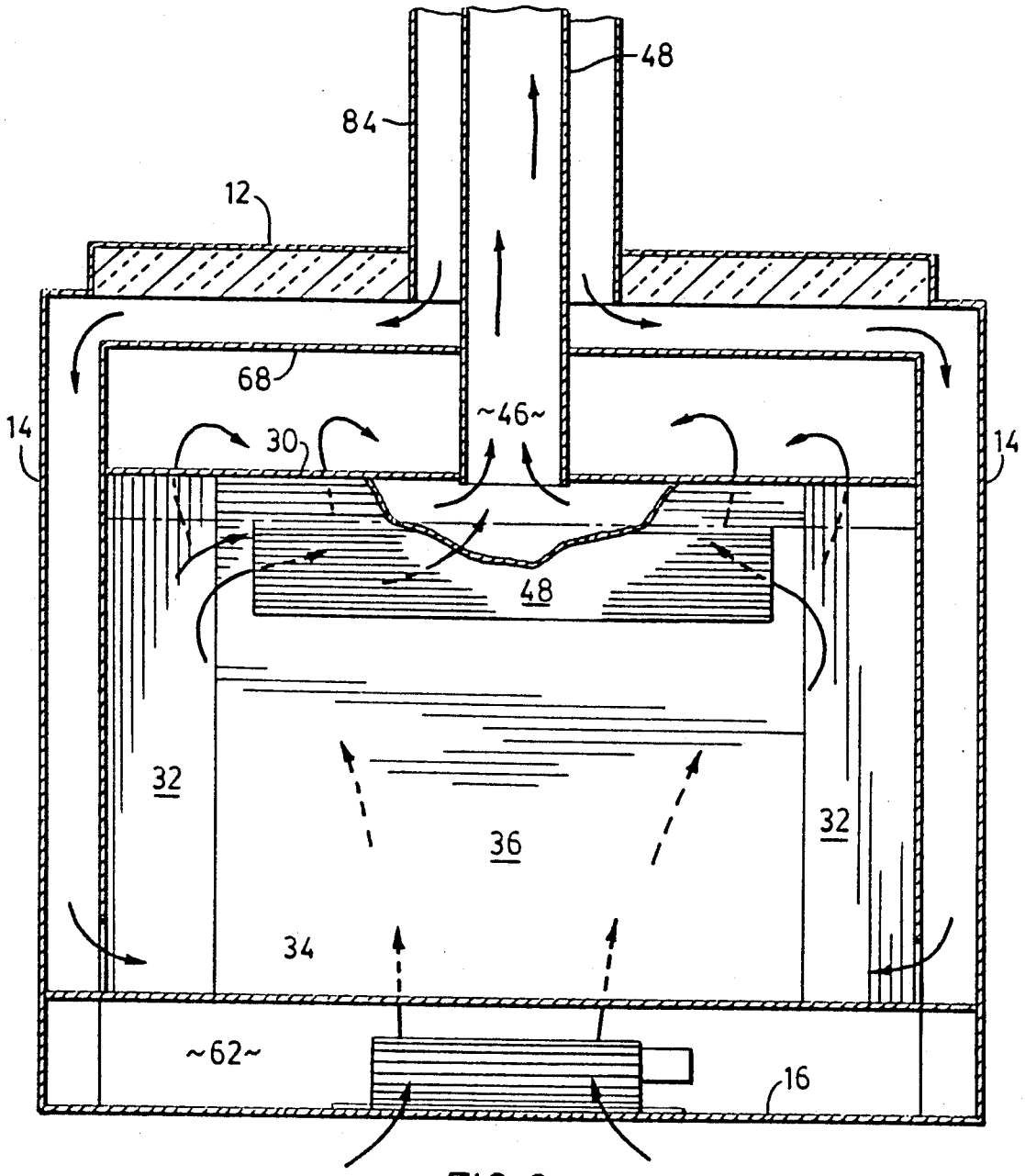
FIG. 3 is a partially cut away front sectional view of the fireplace of FIG. 1.

Flue 46 passes upwardly from the firebox through combustion air plenum 82 and top casing panel 12. Flue 46 may be positioned at any desired location with respect to outer conduit 84. However, as shown in FIG. 3, preferably flue 46 is located within outer conduit 84 and is generally coaxial therewith.

As shown in FIG. 2, the combustion air travels from combustion air plenum 82 to the firebox via air exit port 86, passage 88 and entry port 90. An air exit port 86 is positioned in panel 68 on either side of fireplace adjacent to the front thereof. An entry port 90 is positioned generally below each exit port 86 near bottom panel 34 of the firebox. Combustion air passage 88 comprises a generally rectangular plenum which extends from exit port 86 of combustion air plenum 82 to combustion air entry port 90. While only one air entry port 90 may be provided into the firebox, it is preferred as shown in FIG. 2 to provide a combustion air entry port 90 on each side of the firebox.

The combustion air entry ports may be provided at any number of positions in side panel 32 of the firebox. For example, in the alternate embodiment shown in 7, air entry port 90 is positioned in the lower portion of side panel 32 adjacent rear panel 36 of the firebox. However, as shown in FIGS. 2 and 5, it is preferred that each of the combustion air entry ports 90 is provided in the lower portion of side panel 32 adjacent bottom panel 34 of the firebox and adjacent the front of the firebox. This positioning is advantageous as this directs the combustion air flow, which is relatively cool, along the lower front portion of the fireplace to help keep the door 50 cool.

Figure 7:
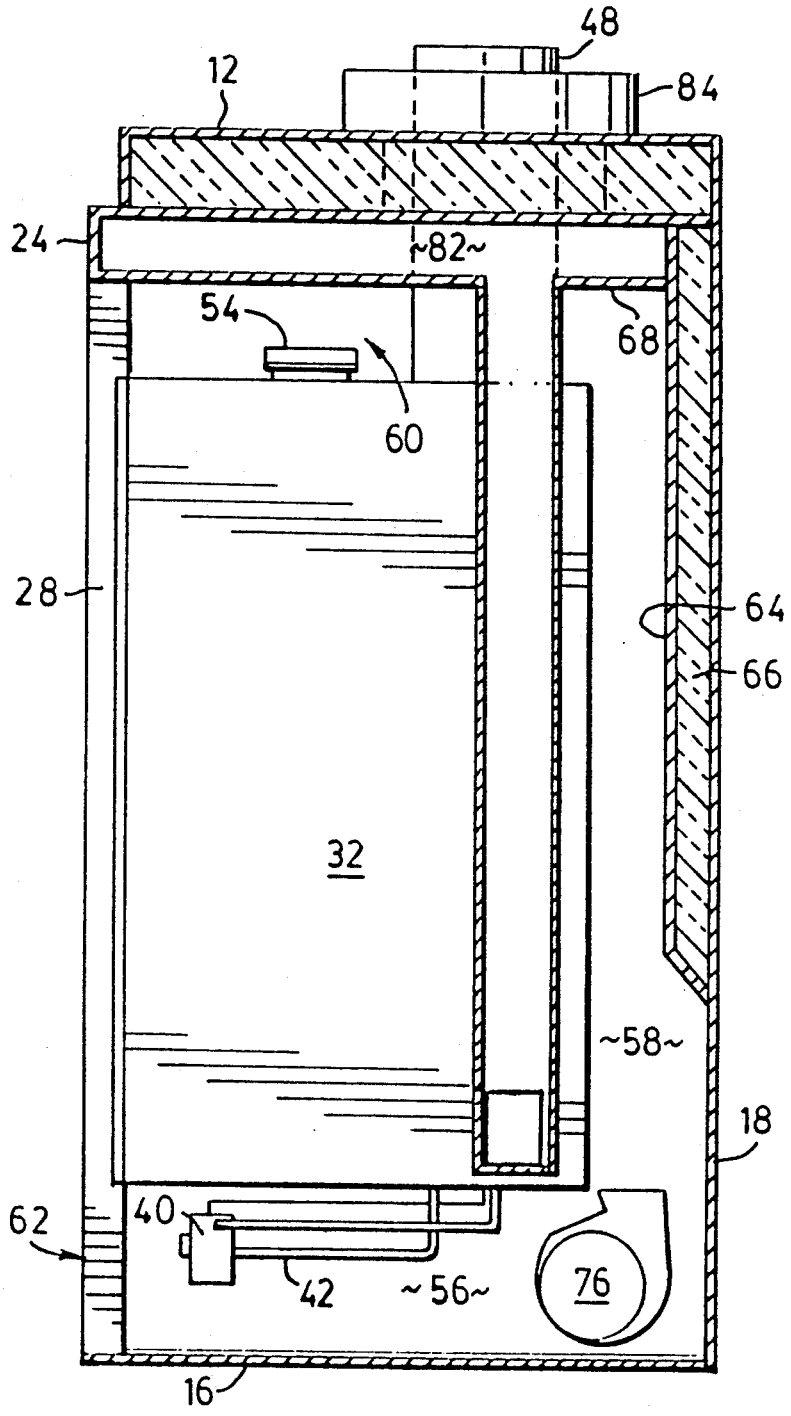
FIG. 7 is a cross-section of an alternate embodiment along the line 5—5 of FIG. 1.
Figure 8:
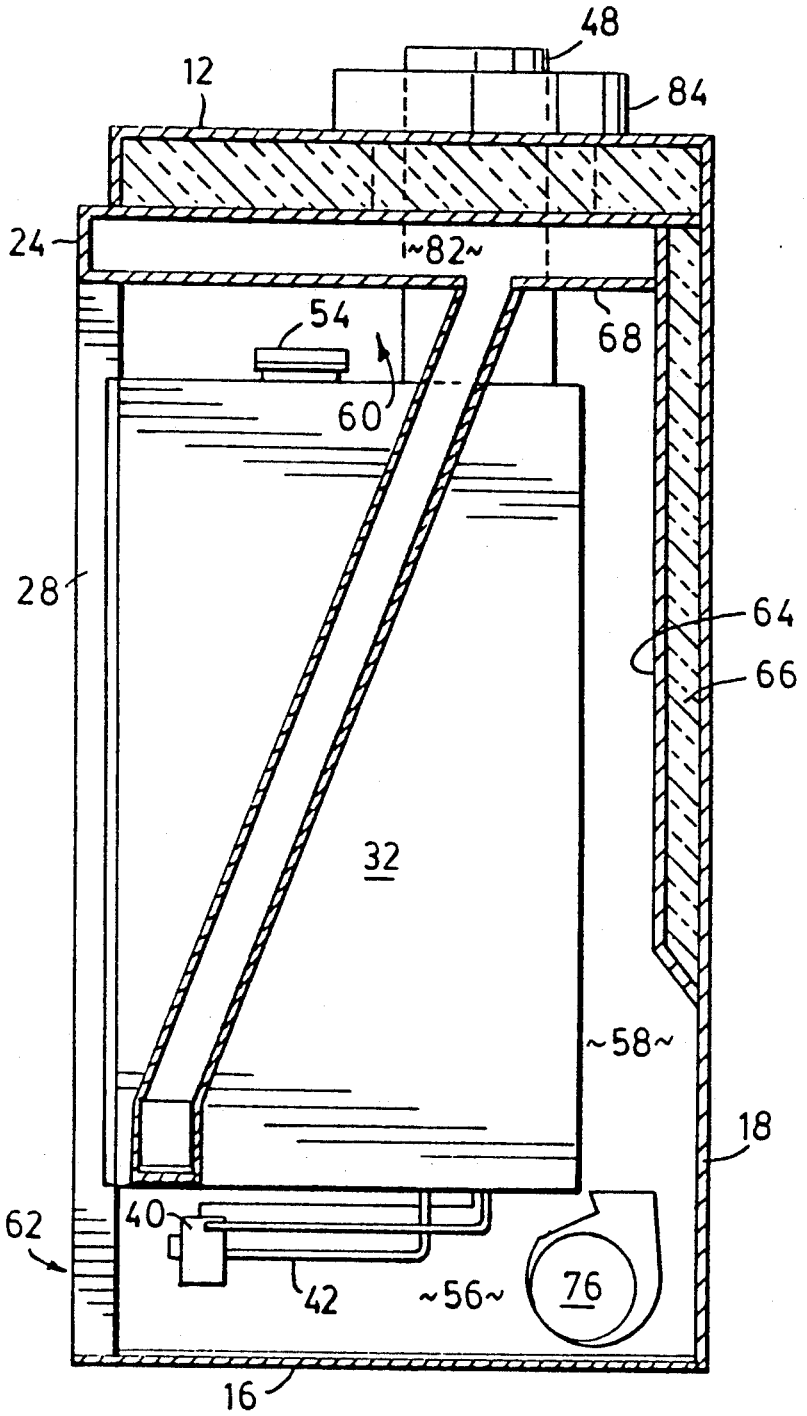
FIG. 8 is a cross-section of a further alternate embodiment along the line 5—5 of FIG. 1; and, FIG. 9 is a cross-section of a further alternate embodiment along the line 5—5 of FIG. 1.
Figure 9:
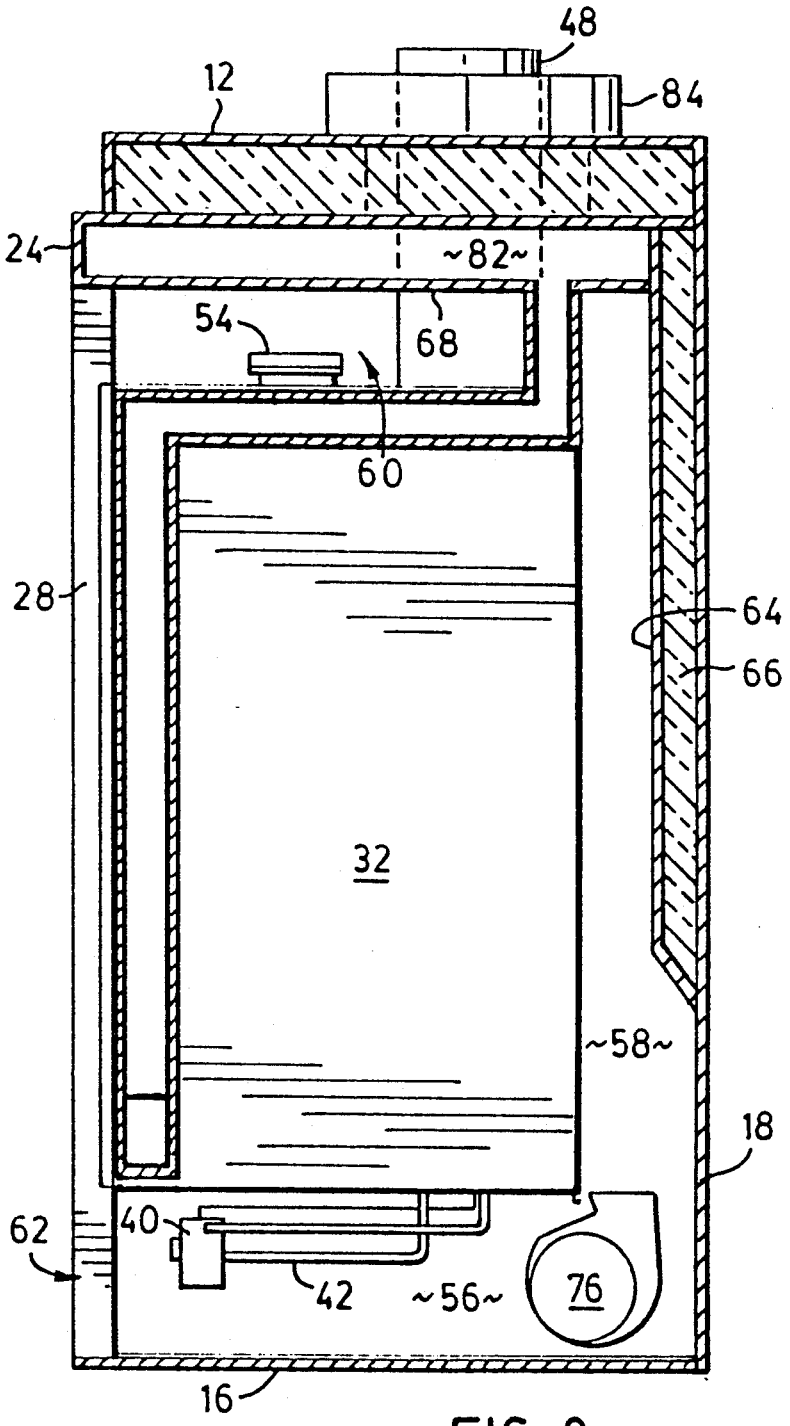

Similarly, combustion air exit port 86 may be positioned at any point along the sides of combustion air plenum 82. For example, as shown in FIGS. 8 and 9, combustion air exit port 86 may positioned towards the rear of combustion air plenum 82. Alternately, as shown in FIG. 5, combustion air exit port 86 may be positioned adjacent the front of the fireplace. Combustion air passage 88 may then travel either in a direct line between exit port 86 and entry port 90 (see FIGS. 5, 7 and 8). Alternately, the passage may extend from exit port 86 towards the front of the fireplace and then downwardly to combustion air entry port 90 (see FIG. 9). By positioning the passage in this manner, at least a portion, if not all of the passage, is located adjacent the rear of front casing panels 20 and 22. The combustion air which travels through passages 90 is relatively cool as compared to the combustion gases. When the passages are located adjacent the rear of front casing panels 20 and 22, the passage of combustion air through passage 90 assists in cooling these panels. Accordingly, as shown in FIGS. 2 and 5, it is preferred to place combustion air plenum exit port 86 adjacent the front of the fireplace and combustion air entry port 90 adjacent bottom panel 34 and adjacent the front of the fireplace so that passage 90 is relatively short while at the same time the length of passage 88 behind front casing panels 20 and 22 is maximized.

Both the outer conduit 84 and flue 46 communicate via conduit means with a location external to the room such as the outdoors. In operation, as shown in FIGS. 2 and 3, combustion air from the outdoors travels through the conduit means to outer conduit 84. The combustion air then passes downwardly through outer conduit 84 into combustion air plenum 82. The combustion air then travels to each side of combustion air plenum 82 and downwardly through passages 88 into the firebox. The combustion air is utilized in the firebox and travels upwardly towards flue 46. If baffle 48 is provided in the firebox, then the air will be deflected towards side panels 32 of the firebox. This is particularly advantageous if room air circulates upwards along side room air plenums 78 so as to increase the transfer of heat from the combustion gases through side panels 32 to the room air travelling along the outside of the side panels. The combustion air travels out flue 46 through combustion air plenum 82 and into conduit means which is communication with, for example, the outdoors.

While the particular design shown in the attached Figures has numerous advantages, it will be apparent to those skilled in the art that numerous modifications, which are within the scope of this invention, may be made to this design including the specific position of the outer conduit, the flue, air exit port 86, air entry port 90 as well as the overall shape of the fireplace itself.

We claim:

1. A fireplace comprising:

(a) a firebox having a front, a bottom panel, a top panel, two side panels, a rear panel and a flue;

(b) an outer casing spaced from and surrounding said firebox;

(c) combustion air feed means positioned at a point above said bottom of said firebox adapted for connection to first conduit means which is in communication with a source external to the room in which the fireplace is situated for supplying combustion air to said fireplace;

(d) combustion air entry port means located in at least one of said side panels near said bottom of said firebox for supplying combustion air to the interior of said firebox;

(e) first passage means positioned between said side panels of said firebox and said outer casing and connecting said combustion air feed means and said combustion air entry port means;

(f) connection means positioned on said flue and adapted for connecting said flue to second conduit means in communication with a source external to the room in which the fireplace is situated for exhausting the combustion gas from the fireplace; and, (g) second passage means positioned between said outer casing and said firebox for circulation of air to be heated along said firebox;

wherein said combustion air travels along said sides of said firebox in said first passage means such that only said air to be heated travels along, and is adjacent to, said rear panel of said firebox.

2. The fireplace of claim 1 wherein said combustion air entry port means is located near the front of said firebox and said first passage means is located in close proximity to said front of said firebox to assist in the cooling of said front of said firebox through conduction of heat to combustion air within said first passage; said first conduit means, said combustion air feed means, said first passage means and said combustion air entry port means all positioned above said bottom of said firebox such that combustion air is supplied to said firebox under gravity flow.

3. The fireplace of claim 2 wherein said combustion air feed means comprises a combustion air plenum positioned above said top panel of said firebox, said plenum having a first port means adapted to be connected to said first conduit means and at least one additional port means in communication with said first passage means whereby, when said first port is connected to said first conduit means, said combustion air passes sequentially through said first conduit means, said first port means, said plenum, said at least one additional port means, said first passage means and said combustion air entry port means into said firebox.

4. The fireplace of claim 3 wherein a said combustion air entry port means is located in each of said side panels and a said first passage means connects each of said combustion port air entry means to said combustion air plenum.

5. The fireplace of claim 3 wherein said combustion air plenum is positioned above said firebox and said at least one additional port means is in communication with said plenum at a position adjacent one side of said plenum and adjacent the front of said fireplace.

6. The fireplace of claim 3 wherein combustion air entry port means is located in each of said side panels, said first passage means connects each of said combustion port air entry means to said combustion air plenum, said combustion air plenum is positioned above said firebox and said at least one additional port means is positioned along each side of said plenum adjacent the front of said fireplace.

7. The fireplace of claim 3 wherein said second passage means includes an upper plenum positioned between said top panel of said firebox and said second conduit means passes through both said upper plenum and said combustion air plenum.

8. The fireplace of claim 7 wherein said second conduit means is positioned within said first conduit means whereby said fireplace is concentrically vented.

9. The fireplace of claim 8 wherein said second passage means also includes a lower plenum positioned between said bottom panel and said outer casing and a rear plenum positioned between said rear panel of said firebox and said outer casing, said rear plenum being in communication with both said upper plenum and said lower plenum and each of said upper and lower plenums being in communication with said room in which said fireplace is located to define a passage for room air to travel around the fireplace.

10. The fireplace of claim 9 wherein said fireplace has a glass door to close the front of said firebox.

11. A fireplace comprising:

(a) a firebox having a front, bottom panel, a top panel, two side panels, a rear panel and a flue;

(b) an outer casing spaced from and surrounding said firebox;

(c) a lower plenum positioned between said bottom panel of said firebox and said outer casing, a rear plenum positioned between said rear panel of said firebox and said outer casing and an upper plenum positioned between said top panel of said firebox and said outer casing, said rear plenum being in communication with both said upper plenum and said lower plenum and each of said upper and lower plenums being in communication with said room in which said fireplace is located to define a passage for room air to travel around the fireplace;

(d) combustion air feed means positioned above said rear panel of said firebox and adapted for connection to first conduit means which is in communication with a source external to the room in which the fireplace is situated for supplying combustion air to said fireplace;

(e) combustion air entry port means located in each of said side panels near said bottom of said firebox for supplying combustion air to the interior of said firebox;

(f) first passage means positioned between said side panels of said firebox and said outer casing and connecting said combustion air feed means and said combustion air entry port means, said first conduit means, said combustion air feed means, said first passage means and said combustion air entry port means all positioned above said bottom panel of said firebox such that combustion air is supplied to said firebox under gravity flow;

(g) connection means positioned on said flue and adapted for connecting said flue to second conduit means in communication with a source external to the room in which the fireplace is situated for exhausting the combustion gas from the fireplace;

wherein said combustion air travels along said sides of said firebox in said first passage means such that only said air to be heated travels along, and is adjacent to, said rear panel of said firebox.

12. The fireplace of claim 11 wherein said each of said combustion air entry port means is located near the front of said firebox and at least a portion of said first passage is positioned adjacent the front of said fireplace.

13. The fireplace of claim 12 wherein said combustion air feed means is positioned above said top panel of said firebox and below said outer casing and said first passage means is in communication with said combustion air feed means at a position adjacent each side of said combustion air feed means and adjacent the front of said fireplace.

14. The fireplace of claim 13 wherein said second conduit means passes through both said upper plenum and said combustion air feed means and said second conduit means is positioned within said first conduit means whereby said fireplace is concentrically vented.

15. The fireplace of claim 11 wherein the firebox also has a baffle, said baffle being fixed to at least one of said panels of said firebox at a position below said flue, said baffle extending substantially across the portion of said firebox below said flue whereby the combustion gases are deflected by said baffle towards said side panels of said fireplace prior to exiting the firebox through said flue, said baffle assisting in the transfer of heat from said combustion gases to said room air.

16. The fireplace as claimed in claim 15 having insulation situated between said outer casing and said rear plenum, and insulation situated between said outer casing and said upper plenum.

17. The fireplace as claimed in claim 16 wherein said firebox includes blow out means to release internal pressure within said firebox if said pressure exceeds a pre-determined value.

18. A method for venting a fireplace having an outer casing and a firebox located within said outer casing comprising admitting combustion air into a combustion air plenum positioned above said firebox, conducting said combustion air to said firebox through a conduit positioned along the sides of said firebox and at least partially adjacent the front of the fireplace and above the bottom of said firebox, combusting said combustion air inside said firebox, and exhausting said combustion air from said firebox through said combustion air plenum.

* * * * *